US006887165B2

(12) United States Patent
Tsurumaki

(10) Patent No.: US 6,887,165 B2
(45) Date of Patent: May 3, 2005

(54) GOLF CLUB

(75) Inventor: Masaei Tsurumaki, Tsubame (JP)

(73) Assignee: K.K. Endo Seisakusho, Tsubame (JP)

( * ) Notice: Subject to any disclaimer, the term of this patent is extended or adjusted under 35 U.S.C. 154(b) by 18 days.

(21) Appl. No.: 10/428,037

(22) Filed: May 2, 2003

(65) Prior Publication Data

US 2004/0121852 A1 Jun. 24, 2004

(30) Foreign Application Priority Data

Dec. 20, 2002 (JP) ..... 2002-369637

(51) Int. Cl.[7] ..... A63B 53/04
(52) U.S. Cl. ..... 473/344
(58) Field of Search ..... D21/752; 473/328, 473/345, 349, 344

(56) References Cited

U.S. PATENT DOCUMENTS 2,550,846 A * 5/1951 Milligan ..... 473/327
3,997,170 A * 12/1976 Goldberg ..... 473/327
4,322,083 A * 3/1982 Imai ..... 473/344
5,480,152 A * 1/1996 Schmidt et al. ..... 473/291
5,735,754 A * 4/1998 Antonious ..... 473/328
5,785,609 A * 7/1998 Sheets et al. ..... 473/327
6,048,278 A * 4/2000 Meyer et al. ..... 473/345
6,447,405 B1 * 9/2002 Chen ..... 473/328

FOREIGN PATENT DOCUMENTS

JP 11-114102 4/1999
JP 11114102 A 4/1999
JP 2002-17908 1/2002
JP 2002-17912 1/2002

* cited by examiner

*Primary Examiner*—Gregory Vidovich
*Assistant Examiner*—Nini F. Legesse
(74) *Attorney, Agent, or Firm*—Westerman, Hattori, Daniels & Adrian, LLP

(57) ABSTRACT

A golf club provides carry which does not deteriorate even when a golf ball is struck in a lower position on a face portion. The golf club includes a face portion 4 having a hitting surface, an improved sole portion 3 which forms a lower portion, and a crown portion 5 which forms an upper portion. A deformation portion B which is capable of elastic deformation is provided in concavoconvex form on the sole portion 3 in a position near the face portion 4. This deformation portion B is constituted by a protrusion 10 which is formed such that the sole portion 3 forms an obtuse angle α, and a concave groove 11 which is formed in a direction linking a toe portion and a heel portion by a protrusion protruding towards the crown portion 5.

5 Claims, 6 Drawing Sheets

| No. | MEASUREMENT LOCATION H | ROBOT TEST (m/s) | | | | | | | CARRY (yard) | | |
|---|---|---|---|---|---|---|---|---|---|---|---|
| | | HEAD SP | BALL SP | LOFT | FACE ANGLE | BACK SPIN | SIDE SPIN | LEFT/RIGHT PLAY | CARRY | RUN | TOTAL |
| 1 | EXAMPLE 28mm | 40.3 | 53.8 | 15.5 | 0 | 2,140 | 126 | 4 | 186 | 21 | 207 |
| 2 | COMPARETIVE EXAMPLE 28mm | 40.4 | 53.7 | 14.6 | -2 | 2,214 | -52 | -9 | 183 | 23 | 206 |
| 3 | EXAMPLE 23mm | 40.4 | 54.2 | 14.2 | 0 | 2,524 | 88 | 4 | 186 | 21 | 207 |
| 4 | COMPARETIVE EXAMPLE 23mm | 40.1 | 53.8 | 12.9 | 0 | 2,534 | 2 | 1 | 180 | 24 | 204 |
| 5 | EXAMPLE 18mm | 40.6 | 54.1 | 12.6 | 1 | 2,712 | 112 | 7 | 181 | 23 | 204 |
| 6 | COMPARETIVE EXAMPLE 18mm | 40.1 | 52.9 | 12.3 | -1 | 2,570 | 170 | 2 | 174 | 25 | 199 |

GOLF CLUB

BACKGROUND OF THE INVENTION

1. Field of the Invention

The present invention relates to a golf club, and more particularly to a golf club having an improved sole portion for enhancing carry.

2. Description of the Related Art

Various golf clubs are prepared in accordance with the conditions of a course. For the tee-off, a golf club known as a driver is used to extend the carry. Since the carry directly influences the quality of the score, the position of the point of contact on the head of the golf club is an important element. The contact surface of a golf club is known as the face, and a user only ever hits a ball with the face, regardless of the playing conditions.

The center of gravity of a golf club when projected onto the face of a driver club head is usually positioned above the central portion of the face when seen from a perpendicular direction to the face. When the shape of the face is observed, it can be seen that the upper face side is wide and the lower side is narrow, thereby forming a substantial inverted trapezoid or a substantial inverted triangle, and due to this relationship, mass is inevitably offset upward. Another reason for this offset is that the part known as a hosel, into which a shaft is inserted, faces upward, thereby adding further upper mass.

Even if the position of the center of gravity is substantially 60% from the bottom surface in the height of the face, for example, this is referred to as a low center of gravity model. A contact position known as the sweet area lies in the vicinity of the center of gravity and is the area at which the greatest carry can be achieved. Hence in order to produce the greatest restitution on the head to thereby achieve carry, a ball must normally be struck on the sweet area above the central portion of the face. Depending on the conditions of the course, however, regular amateur golfers whose point of contact varies and even professional golfers may purposely shift the position of the contact point.

If a ball is struck normally against a head wind, for example, the ball is caught up in the wind and does not carry, and therefore the ball is struck at a low trajectory. In this case, the point of contact becomes the lower direction of the face. As a result, however, restitution force decreases and carry is not as great as when the ball is struck on the sweet area. Since the center of gravity is in the upper portion of the face, or in other words the sweet area which is a high restitution area is in the vicinity of the center of gravity, as described above, restitution force decreases when the point of contact deviates from this area.

Hence demands have been made for a restitution force comparable to that of the conventional sweet area in a lower position on the face portion, and various methods have been proposed to meet these demands. As a method of increasing restitution force, for example, a golf club has been disclosed (see Japanese Patent Application No. 2002-17912, for example) in which the specific surface area of the face is limited and a coefficient of restitution is set such that carry deterioration is reduced even when a ball is struck in an offset position. As a method of lowering the center of gravity in a downward direction to thereby increase restitution force in a lower position, methods such as providing a dead weight in a lower position or widening the lower direction side have been proposed (see Japanese Patent Application No. 2002-17908, for example).

As described above, techniques have been designed for increasing carry under various conditions, but none have solved the problem completely satisfactorily. There is particular scope for further improvements in restitution in a lower position removed from the sweet area. To described in more detail the aforementioned method which is implemented by limiting the specific surface area of the face and setting a coefficient of restitution, the thickness of the face portion is reduced in a specific region such that the thickness changes from the central portion to the periphery, and as a result the restitution effect is enhanced.

However, although this method is effective under specific circumstances, the restitution effect is not reliably enhanced in the lower direction of the face portion. Further, although the method of providing a dead weight is effective in itself, there are limitations on the recent trend of enlarging the head. More specifically, when the head is enlarged, a new problem arises in that the mass of the club head increases with the addition of the dead weight. The golf world by nature attaches great importance to tradition.

When the shape, mass, and so on of the head are greatly altered, a player may suffer adverse effects such as having to alter his/her swing, losing his/her rhythm, and so on. Even if an innovative club were to be developed, a long period of time would be required for the club to become established in practice. Since various difficulties are caused by greatly changing the shape of the currently established club, an ideal solution lies in the development of a golf club which is functionally improved but not greatly altered in shape from its present state, and which is therefore satisfactory to golfers.

Hence it is desirable to develop a golf club which does not differ greatly in shape from a conventional club, which is not limited in its specific functions, in which the restitution area, and particularly the lower direction thereof, can be expanded, which comprises a conventional sweet area but has improved restitution even in the lower direction, which is stable, and in which carry is increased even in head wind conditions.

The present invention has been designed on the basis of the aforementioned technical background, and achieves the following objects.

SUMMARY OF THE INVENTION

An object of the present invention is to provide a golf club with improved restitution force in a lower position on the face portion such that carry does not decrease when a ball is struck not only in the conventional sweet area, but also in the portion below the conventional sweet area.

Another object of the present invention is to provide a golf club in which, by altering only a part of the sole portion rather than altering the conventional shape of the club, conventional hitting performance can be improved upon without altering the basic conventional shape of the club.

A further object of the present invention is to provide a golf club which can be mass-produced at low cost.

The present invention employs the following means to achieve these objects.

A golf club of a first invention comprises a face portion disposed on the front face of a driver club head and having a hitting surface for hitting a golf ball, a sole portion which forms the lower portion of the driver club head, a crown portion which forms the upper portion of the driver club head, and a deformation portion disposed on the sole portion which is capable of elastic deformation when a golf ball is struck.

In a golf club of a second invention, the deformation portion in the golf club of the first invention comprises at least one concave groove formed in a direction linking a toe portion and a heel portion by a protrusion protruding towards the crown portion.

In a golf club of a third invention, the deformation portion in the golf club of the first invention comprises at least one convex portion formed in the direction linking the toe portion and the heel portion by a protrusion protruding towards the crown portion.

In a golf club of a fourth invention, the deformation portion in the golf club of the second or third invention is disposed on the face portion side.

In a golf club of a fifth invention, the deformation portion in the golf club of the first invention comprises a protruding part which protrudes such that the sole portion is formed, in continuation with the hitting surface and the face portion, in an obtuse angle as viewed in a cross section cut along a vertical plane including a perpendicular to the hitting surface in order to enhance an elastic effect.

In a golf club of a sixth invention, the protruding part in the golf club of the fifth invention comprises at least one concave groove formed in the direction linking the toe portion and the heel portion by a protrusion protruding towards the crown portion.

In a golf club of a seventh invention, the concave groove in the golf club of the sixth invention is disposed on the face portion side.

In a golf club of an eighth invention, the protruding part in the golf club of the fifth invention comprises at least one convex portion formed in the direction linking the toe portion and the heel portion by a hollow recessed towards the crown portion.

In a golf club of a ninth invention, the convex portion in the golf club of the eighth invention is disposed on the face portion side.

DESCRIPTION OF THE PREFERRED EMBODIMENTS

Figure 1:
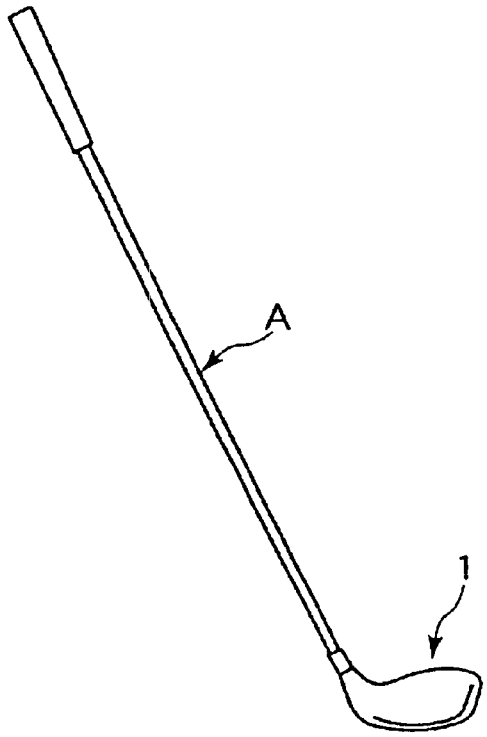
FIG. 1 is an external view showing the entirety of a golf club.
Figure 2:
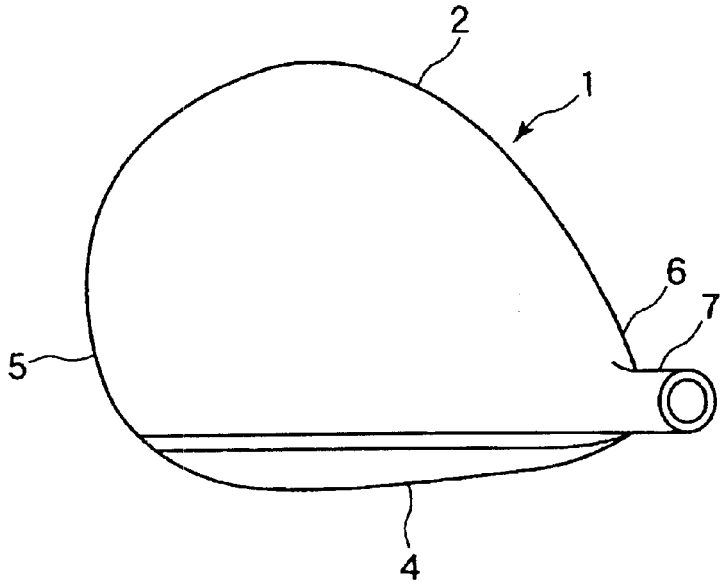
FIG. 2 is a plan view of a driver club head of the present invention.
Figure 3:
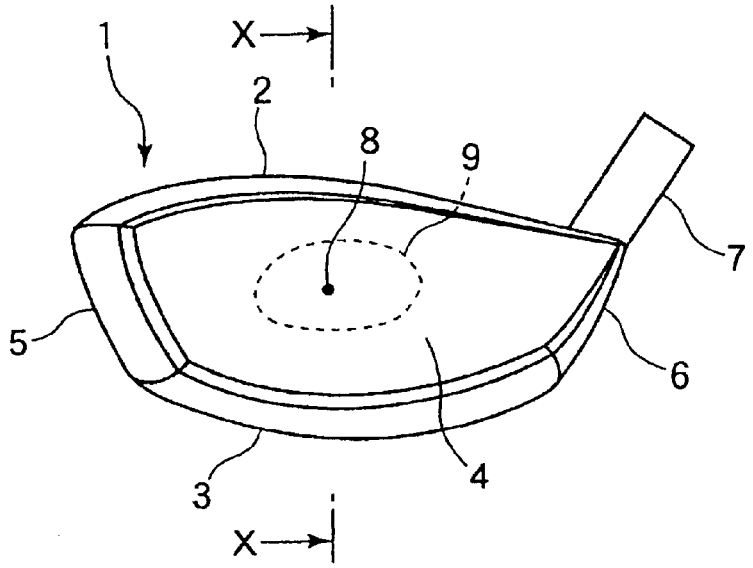
FIG. 3 is a front view of the driver club head of the present invention.
Figure 4:
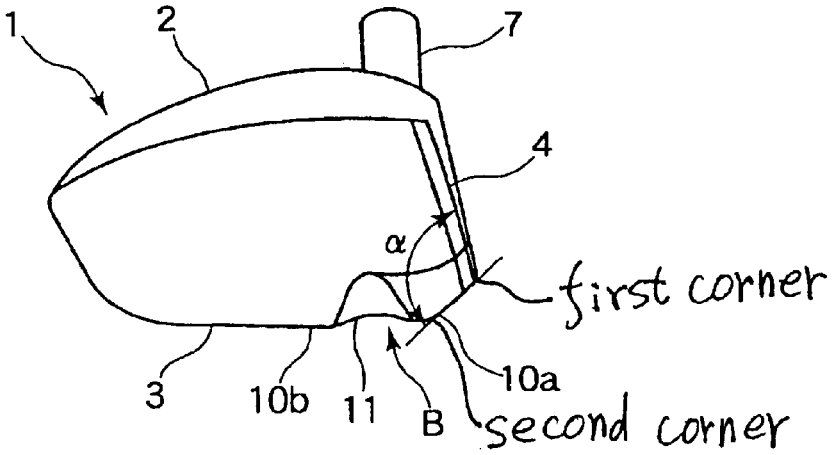
FIG. 4 is a side view of the driver club head according to a first embodiment of the present invention.

FIG. 1 is an external view showing the entirety of a golf club according to the present invention having a driver club head. The golf club of the present invention is provided with a hollow metallic golf club head, and the head of a driver club is the subject of the description of this embodiment. A driver club head 1 according to the present invention is supported on a shaft A. Embodiments of the driver club head 1 of the metallic golf club according to the present invention are illustrated in FIGS. 2 to 4. Note that the figures illustrate only the head portion and members such as the shaft A have been omitted therefrom.

FIG. 2 is a plan view, FIG. 3 is a front view, and FIG. 4 is a side view. As shown in the drawings, the driver club head 1 is constituted by a crown portion 2 which corresponds to the upper portion, a sole portion 3 which corresponds to the base portion, a face portion 4 with which a golf ball is struck, a toe portion 5 which corresponds to the front portion of the head, a heel portion 6 which corresponds to the rear portion of the head, and a hosel portion 7 which is a member for supporting the driver club head 1 on the shaft A.

Each portion is formed into a single member by joining an individual or plurality of portions during production, thereby constituting an equally divided component which is integrated by press working and then welding or the like. For example, the component is comprised of five points: the face portion; the sole portion; the crown portion; the hosel portion; and a weight. A plate material is blanked into a predetermined form, heated, and press worked. For example, the face portion is heated to 400° C., and the body comprising the sole, crown, and so on is heated to 900° C. After pressing, burrs are trimmed and TIG arc welding is applied. In this embodiment, the material is a titanium alloy, and the component is connected by abutting the face portion-related members and the sole portion-related members, then by connecting the hosel portion-related members thereto, and then by connecting the pressed crown-related members by means of TIG arc welding. In so doing an integrated driver club head 1 is constructed. Following welding, the driver club head is subject to an age-hardening process (5 hours in 515 hours), polished, and then painted to reach completion.

The face portion 4 has a slightly curved surface formed by adhering plate-form boards together. The largest coefficient of restitution region is a sweet area 9 in the vicinity of the center of gravity 8. To drive a golf ball long distances, it is generally effective to hit the golf ball in this sweet area 9, and therefore the coefficient of restitution of this part is set to a high level. It is well-known that a golf ball can be driven for long distances if the coefficient of restitution is high, and since the coefficient of restitution is considered to be an important element in golf club performance, a benchmark therefor has been determined by the United States Golf Association (USGA). This benchmark is determined by the following equation.

$$Vout/Vin=eM-m/M+m$$

In this equation, m indicates the average mass of a test ball, M indicates the mass of the head, Vout indicates the velocity of the test ball following impact, and Vin indicates the velocity of the test ball prior to impact. Hence Vout/Vin is the velocity ratio. e is the coefficient of restitution. According to regulations, Pinnacle Gold (brand name) balls are used as test golf balls, each marked in advance with a number and with the initial velocity thereof measured and recorded. The average weight of the ball is 45.4 grams.

It is stipulated that the ball be kept in a room at 23±1.0° C., and impact velocity is determined at 48.8 m/s. Detailed regulations are also provided for testing instruments such as a ball launching device and a ballistic screen, and the testing method is regulated in similar detail through mapping and so on. The baseline value for the coefficient of restitution is e−0.822. Whether a head is suitable or not is determined according to these provisions based on measured mass by comparing the velocity ratio of the actual impact and the baseline velocity ratio.

Alternatively, the coefficient of restitution can be calculated by a reverse operation using the aforementioned equation if other conditions are determined, and therefore if the mass of the head is altered by altering the thickness or the like of the face portion 4, the coefficient of restitution can be calculated and an optimum numerical setting can be determined. As is shown by the aforementioned equation, if the velocity of the golf ball following impact is high, then the coefficient of restitution is high. In the present invention, tests were performed on the basis of such provisions in order to find ways to move the conventional sweet area in a lower direction and increase the size thereof.

Figure 5:
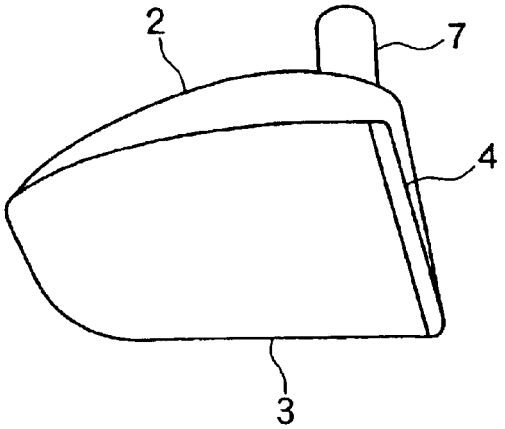
FIG. 5 is a side view of a conventional driver club head.

Embodiments of the present invention will be described in detail below. FIG. 5 is a side view of a conventional driver club head, and corresponds to the side view of the first embodiment of the present invention illustrated in FIG. 4. Compared to FIG. 5, improvements have been added to the sole portion 3 of the present invention. As shown in FIG. 4, the club head is provided with a protrusion 10 and a concave groove 11 which are formed on the face portion 4 side of the sole portion 3 in a direction linking the toe portion 5 and heel portion 6 so as to protrude and to be recessed towards the crown portion 2, respectively. The protrusion 10 is constituted by a protrusion 10*a* on the face portion 4 side and a second protrusion 10*b* which is formed so as to gently face toward the rear heel portion 6, and the concave groove 11 is interposed between these protrusions 10*a*, 10*b*.

Figure 6:
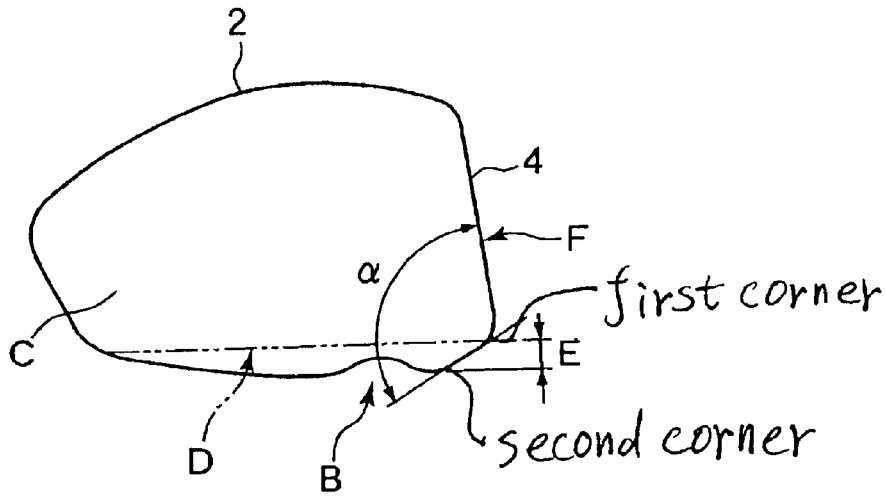
FIG. 6 is a cross section along the X—X line in FIG. 3, and illustrates the first embodiment.

As shown in the drawing, the protrusion 10 and concave groove 11 overall form a smooth curve. On the face portion 4 side, the sole portion 3 is formed into an obtuse angle α in a cross section cut along a vertical plane perpendicular to the face portion 4 plane. This concavoconvex portion is provided on the sole portion 3 in order to provide the sole portion 3 with an elastic effect, and this concavoconvex portion, which serves as a deformation portion B capable of elastic deformation, is a feature of the present invention. FIG. 6 is a cross section along the X—X line in FIG. 3, and shows a simplification of the first embodiment.

As described above, this head portion is a press worked component. Accordingly, the part corresponding to the visible outline in the drawing is a pressed member formed from a titanium alloy, and the interior C is a space. In the drawing, a portion D indicates the position of a conventional sole portion, but the present invention is constituted such that one part overhangs the portion D as shown in the drawing and such that the deformation portion B is provided on the face portion 4 side. The overhang thickness E of the deformation portion B is approximately 6 mm, for example. When a hitting force of F is applied to the face portion 4 plane, as shown by the arrow in the drawing, the head itself undergoes complex elastic deformation. In the present invention, however, the concavoconvex deformation portion B is provided on the sole portion 3, and as a result this elastic deformation is largely concentrated toward the sole portion 3 side.

Thus an elastic effect equivalent to a conventional constitution in which restitution force is increased by reducing the thickness of the lower face portion 4, for example, is obtained in the sole portion 3 without modifying the conventional face portion 4. Hence the negative effect of weakened rigidity in the head portion caused by intentionally reducing the thickness of the face portion 4 in order to increase the restitution force is avoided. The deformation portion B is not limited to the form shown in this example. Although a concavoconvex form is preferable, any form may be employed as long as an elastic effect is achieved.

Figure 7:
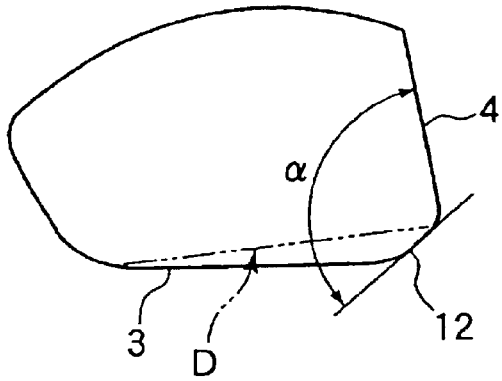
FIG. 7 is a cross section along the X—X line in FIG. 3, and illustrates a second embodiment.

FIG. 7 illustrates a second embodiment. On the face portion 4 side of the sole portion 3 in this case, the sole portion 3 is formed into an obtuse angle α in a cross section cut along a vertical plane perpendicular to the face portion 4 plane, and only a protrusion 12 is formed so as to overhang from the conventional form. Unlike the aforementioned constitution, no concave groove is provided, and the protrusion 12 is provided on the face portion 4 side. When a hitting force is applied to the face portion 4, this protrusion 12 undergoes elastic deformation and the coefficient of restitution of the head is raised.

Figure 8:
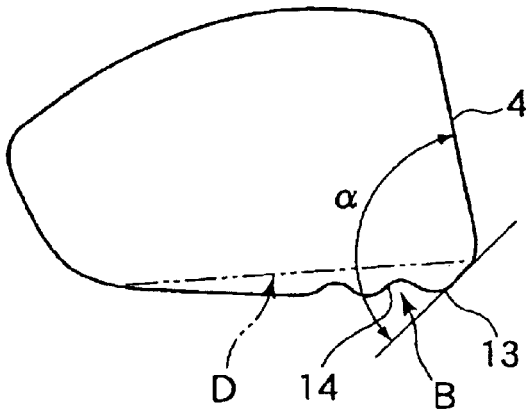
FIG. 8 is a cross section along the X—X line in FIG. 3, and illustrates a third embodiment.

FIG. 8 illustrates a third embodiment. On the face portion 4 side of the sole portion 3 in this case, as above, the sole portion 3 is formed into an obtuse angle α in a cross section cut along a vertical plane perpendicular to the face portion 4 plane, and a plurality of concavoconvex portions are provided on the face portion 4 side. As shown in the drawing, protrusions 13 are provided in three locations, and concave grooves 14 are provided in two locations. The restitution effect is similar to that described above, but due to spatial restrictions, the concavoconvex form is slightly smaller than in the previous example.

Figure 9:
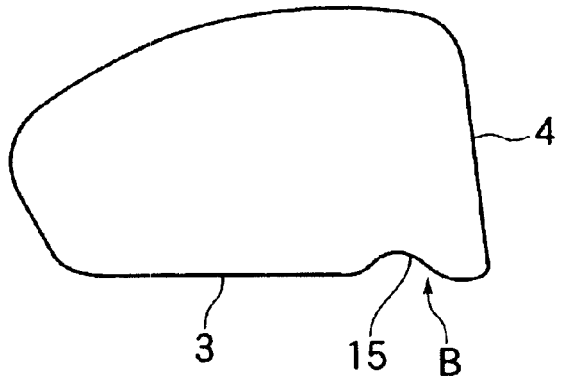
FIG. 9 is a cross section along the X—X line in FIG. 3, and illustrates a fourth embodiment.
Figure 10:
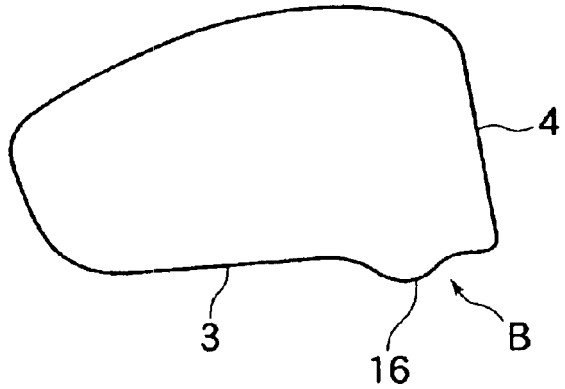
FIG. 10 is a cross section along the X—X line in FIG. 3, and illustrates a fifth embodiment.

FIG. 9 illustrates a fourth embodiment. In this case, the deformation portion B which is capable of elastic deformation, or in other words a concave groove 15, is provided in a conventionally constituted sole portion 3. FIG. 10 illustrates a fifth embodiment. In this case, the deformation portion B which is capable of elastic deformation, or in other words a protrusion 16, is provided in a conventionally constituted sole portion 3. An elastic effect is achieved in the same manner as in the aforementioned embodiments, but in the examples in FIGS. 9 and 10, the position of the concave groove 15 or protrusion 16 is nearer to the point of contact.

Five embodiments of the present invention were explained herein above, but the present invention is by no means limited to these embodiments. The deformation portion B preferably has the described concavoconvex form, but may take a V-shaped form or a type of accordion form. As long as the elastic effect is increased, the deformation portion B may take any form.

EXAMPLE

Figure 11:
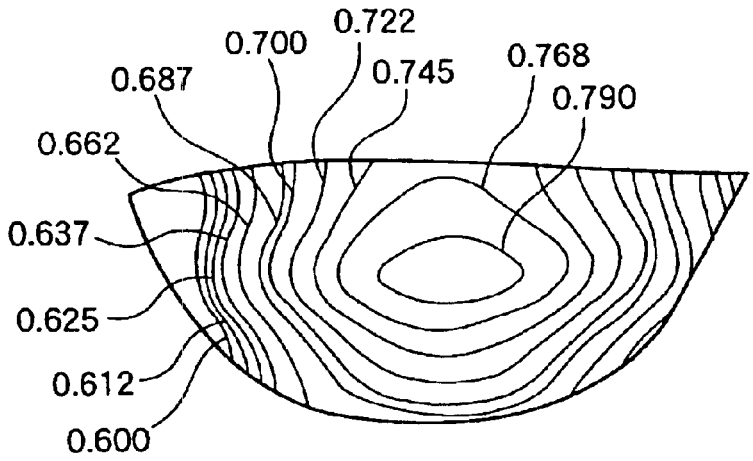
FIG. 11 is a diagram showing the distribution of coefficients of restitution on the head according to the first embodiment.
Figure 12:
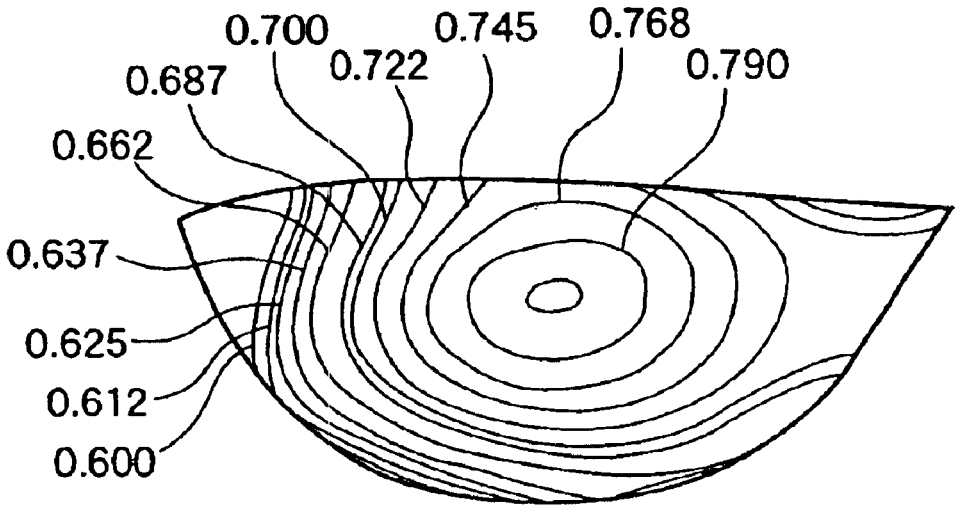
FIG. 12 is a diagram showing the distribution of coefficients of restitution on a head in a conventional embodiment.

An example of performance improvement relating to these constitutions will now be described. FIG. 11 illustrates the results of an experiment applied to the golf club of the first embodiment of the present invention. FIG. 11 shows the distribution of coefficients of restitution when a golf ball is struck on the face portion 4. On the basis of the experiment results, the positions of identical coefficients of restitution are plotted on the drawing as contour lines. FIG. 12 shows the results of an experiment performed under identical conditions to that in FIG. 11 in respect of a conventional golf club. The experiment was performed under the following conditions.

Face portion material: cold-rolled Ti-15 V-3 Cr-3 Sn-3 Al material; plate thickness 2.9 mm Sole portion material: Ti-15 V-3 Cr-3 Sn-3 Al; plate thickness 1.15 mm Crown portion material: Ti-15 V-3 Cr-3 Sn-3 Al; plate thickness 1.0 mm Volume: approx. 300 cc; mass: approx. 196 g.

When FIGS. 11 and 12 are compared, it is clear that the high coefficient of restitution values tend toward the sole portion side. This means that when contact is made on the face portion plane even in the vicinity of the sole portion, a golf ball can be driven for a longer distance than conventionally.

Figure 13:
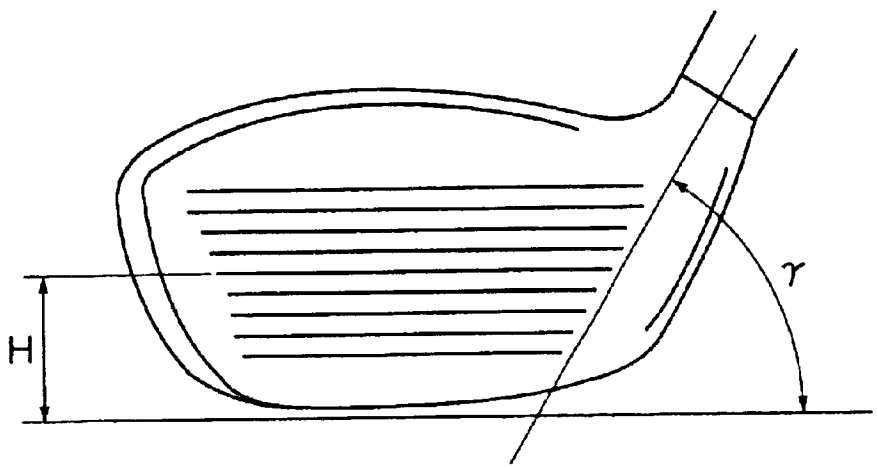
FIG. 13 is an illustrative view showing a measurement comparison of the carry in the first embodiment and the conventional embodiment.
Figure 13:
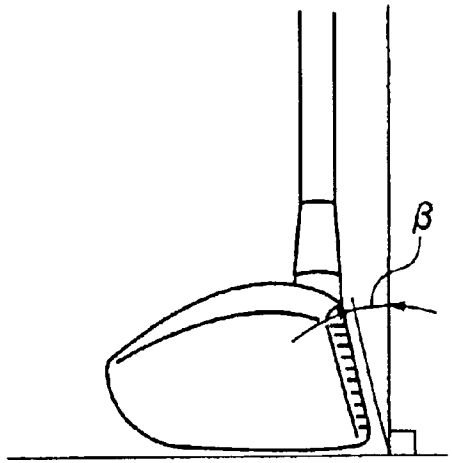

FIG. 13 shows a measurement comparison of the carry in the example of the present invention and a conventional example in a hitting test performed by a robot. The drawing shows a measurement comparison with a head speed of 40 m/s. As shown in the drawing, the position H of the measurement location is a distance from the leading edge. In the drawing, "example" indicates the first embodiment of the present invention and "comparative example" indicates the conventional example. The test was performed by a robot under identical hitting conditions for both the example and the comparative example. These hitting conditions are as shown in the items in FIG. 13.

The specifications of the club used in the test are as follows:

Club length: 44.5"

Balance: D2

Loft angle β: 10.5°

Lie angle γ: 56.5°

Shaft FLEX: R

When the carry results are compared, in a measurement location position H of 18 mm, for example, the example is 204 yards, whereas the comparative example is 199 yards, and thus the effect of the constitution of the present invention becomes clear.

As described in detail above, the sole portion of the golf club according to the present invention is provided with an elastic effect, and thus restitution force is improved in a lower position on the face portion such that a golf ball can be driven for long distances with no deterioration in carry when the ball is struck not only in the conventional sweet area, but also below the conventional sweet area. Further, since the basic form of the golf club is not changed from the conventional form and only one part of the sole portion is altered, hitting performance is improved beyond that of a conventional club without altering the external appearance of the club. Moreover, since the procedure for applying an elastic effect to the sole portion can be implemented by an identical press working operation to that performed conventionally, the club can be mass-produced similarly to a conventional club without increasing production costs and with improved performance.

What is claimed is:

1. A golf club comprising:

a face portion disposed on the front face of a metallic hollow golf club head and having a hitting surface for hitting a golf ball;

a sole portion which forms the lower portion of said metallic hollow golf club head; and a crown portion which forms the upper portion of said metallic hollow golf club head;

wherein said sole portion comprises;

a deformation portion disposed on said sole portion which is capable of elastic deformation when a golf ball is struck;

wherein said deformation portion includes;

a protruding part which protrudes such that said sole portion is formed in an obtuse angle, in continuation with said hitting surface and said face portion, as viewed in a cross section cut along a vertical plane including a perpendicular to said hitting surface in order to enhance an elastic effect;

said protruding part have a first corner in said obtuse angle linking said face portion and said sole portion, and a second corner in said sole portion.

2. The golf club according to claim 1, wherein said deformation portion comprises at least one convex portion formed in the direction linking the toe portion and the heel portion by a protrusion protruding towards said crown portion.

3. The golf club according to claim 2, wherein said deformation portion is disposed on the side of said face portion.

4. The golf club according to claim 1, wherein said protruding part comprises at least one concave groove formed in the direction linking the toe portion and the heel portion by a protrusion protruding towards said crown portion.

5. The golf club according to claim 4, wherein said concave groove is disposed on the side of said face portion.

* * * * *